US005083954A

United States Patent [19]

Jacobs

[11] Patent Number: 5,083,954

[45] Date of Patent: Jan. 28, 1992

[54] SWIM FIN RETAINER

[76] Inventor: Edward R. Jacobs, 1221 SE. Godsey #10, Dallas, Oreg. 97338

[21] Appl. No.: 467,734

[22] Filed: Jan. 19, 1990

[51] Int. Cl.[5] ..... A63B 31/11

[52] U.S. Cl. ..... 441/64; D21/239

[58] Field of Search ..... 441/61-64; 36/122; 280/611, 11.3, 11.31, 11.33, 616, 623, 632; D21/239

[56] References Cited

U.S. PATENT DOCUMENTS 2,779,077 1/1957 Kline ..... 441/64
3,940,815 3/1976 Hill ..... 441/64
4,795,384 1/1989 Hattori ..... 441/64
4,795,385 1/1989 Matsuoka ..... 441/64

*Primary Examiner*—Jesus D. Sotelo
*Attorney, Agent, or Firm*—John P. Halvonik

[57] ABSTRACT

The invention relates to an improved swim fin retainer that provides a locking mechanism for attaching the fin to the user's foot. The improved swim fin retainer utilizes a latching mechanism that is in connection with a heel strap so that the swim fin can be attached and removed in one action. The provides an easy method for attaching and detaching swim fins without having to use one's hands.

5 Claims, 3 Drawing Sheets

SWIM FIN RETAINER

BACKGROUND OF THE INVENTION

1. Field of the Invention

The invention is in the field of underwater recreation and more particularly swim fins. The device of the present invention provides an improved swim fin retaining mechanism that allows the user to attach the swim fin to his foot with a one step maneuver. The retaining mechanism has a locking latch assembly that secures the back strap of the fin to the user's foot. It also allows for a one step release of the fin by pushing down on the locking latch.

2. Description of the Prior Art

The prior art does contain retaining mechanisms for attaching the swim fin to the user's foot, but none of them allow the foot and the back of the heel to be retained with one movement of the locking mechanism. See. for example, U.S. Pat. No. 3,940,815 to Hill and U.S. Pat. No. 2,779,077 to Kline.

The swim fin retainer of the present invention represents an improvement on existing fin strap systems because the fins can be put on without using one's hands. On existing fins the strap that holds the swimmer's heel has to be stretched and placed behind the heel by hand. This may cause the person to lose his balance while attempting to put on the fins. A swimmer loaded down with SCUBA equipment on his back may find it especially hard to put on his fins using these mechanisms.

SUMMARY OF THE INVENTION

The invention provides a one-step swim fin retaining mechanism that uses a locking latch assembly to secure the swim fin to the user's foot. The latch assembly is connected to a heel retaining strap that goes around the back of the user's heel. The assembly allows the back strap of the fin to be tightened to around the user's heel with a one-step movement. The latch assembly also allows the fin to be detached with a simple push downward on the latch.

It is the object of this invention to provide an improved swim fin retaining device that can be attached to the user's foot and heel with a one step movement.

It is another object of the invention to provide a swim fin retaining device that can be released from the user's foot with a one step movement.

Still another object of the invention is to provide a swim fin retaining device that can be attached and removed without using one's hands.

DRAWINGS

Figure 1:
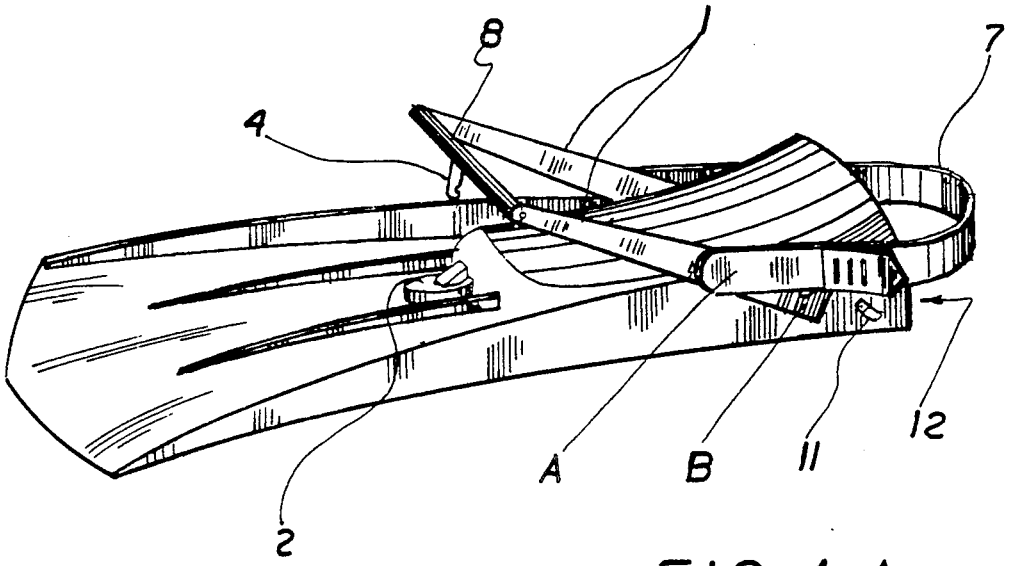
FIG. 1 shows a view of the entire fin with the locking assembly.

List of reference numerals:

1. Locking lever or connecting strap (one on each side of the fin)
2. Position of the latch assembly
3. Optional strap extension

4. Locking pin..
5. Pivot Latch
6. Latch Pivoting Pin
7. Heel strap
8. Cross bar
9. Foam pad or spring
10. Latch housing
11. pivot stop (one on each side of the foot pocket)
12. Foot pocket opening
A. Point at which strap (7) is attached
B. Point at which lever (1) is attached
C. Open Position of locking pin
D. Closed Position of locking pin
G point at which to push down to release locking pin

DESCRIPTION OF THE PREFERRED EMBODIMENT

The general construction of the swim fin with the retaining latch is shown in FIG. 1 which shows the heel strap 7 connected to the locking pin 4 through means of the locking lever or connecting strap 1. The invention is a new component part to be attached to swim fins used by SCUBA divers and swimmers. This component allows a swimmer to put his fins on or take them off easier by tightening and locking the heel strap 7 through the pin 4 and latch 5 or by loosening the strap 7 by conventional strap lengthening and locking means located near point A in FIG. 1. Conventional means include, for example, hooks and clasps and similar means for locking straps.

Figure 1A:
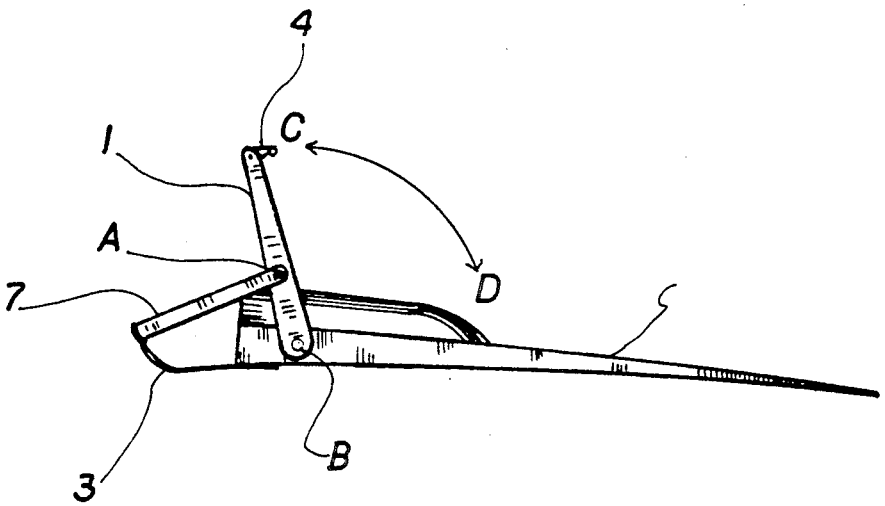
FIG. 1A shows the optional strap extension.
Figure 2:
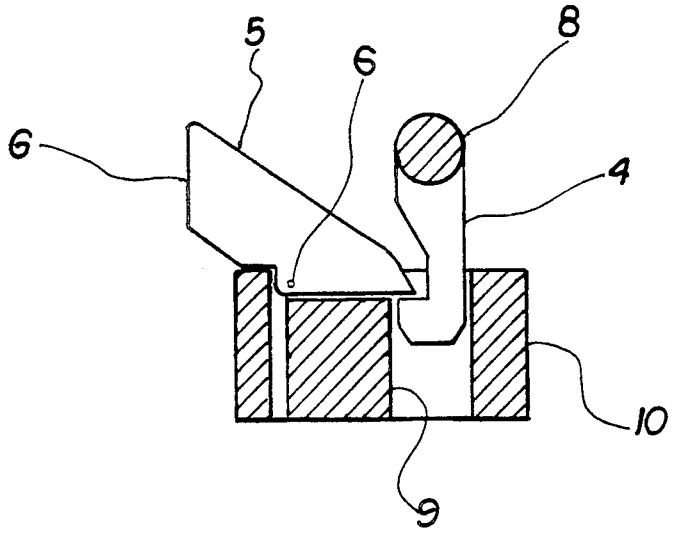
FIG. 2 shows the detail of the latch mechanism.

The locking latch is made up of the locking pin 4, the pivot latch 5 and corresponding pivot pin 6 and resilient means 9, shown in FIG. 2. The locking pin 4 is locked into the latch 5 at point 2 in FIG. 1A when the pin is pushed to position d shown in FIG. 2. The purpose is to secure the locking lever 1 in a secure position while the swim fin is being worn. As the locking lever 1 (known also as the connecting strap that connects the locking pin 4 to the heel strap 7) is tightened onto the top of the fin, the fin will be retained to the user's foot by the tightening of the heel strap 7 against the back, of the user s foot and this secures the fin onto the user's foot.

The length that the heel strap projects from the connecting strap 1 can be set manually by conventional means located on the heel strap, possibly at point A, so that individual foot lengths can be set for each foot. This allows a heel length to be set for each individual and then locked by means of the locking latch.

At the tip of the locking lever 1 is a locking pin 4 which has a crossbar 8 attached to it. The crossbar facilitates handling the locking lever. As the locking lever is forced down, the locking pin comes in contact with the pivot latch 5. This causes the latch to pivot on pivot pin 6 against the foam padding 9. The foam padding is used as a spring to keep the latch 5 in a locked position and yet allow pin 4 to slip in past the latch 5 and become locked. Other, alternative arrangement based on suitable resilient means are also possible. This allows the pin to move past the latch 5 and be secured against it from coming back out since the indentation 10 will bump against the latch and prevent the pin from coming out unless the latch is again pivoted downward. FIG. 2 shows this as the fully locked position.

The latch mechanism is unlatched by holding the cross bar 8, see FIG. 2, with ones fingers and using one's thumb of the same hand to press on pivot latch 5 near point G causing the pivot latch 5 to pivot on pin 6 releasing pin 4. The bar 8 can also be used to facilitate the removal of the pin 4.

Figure 3:
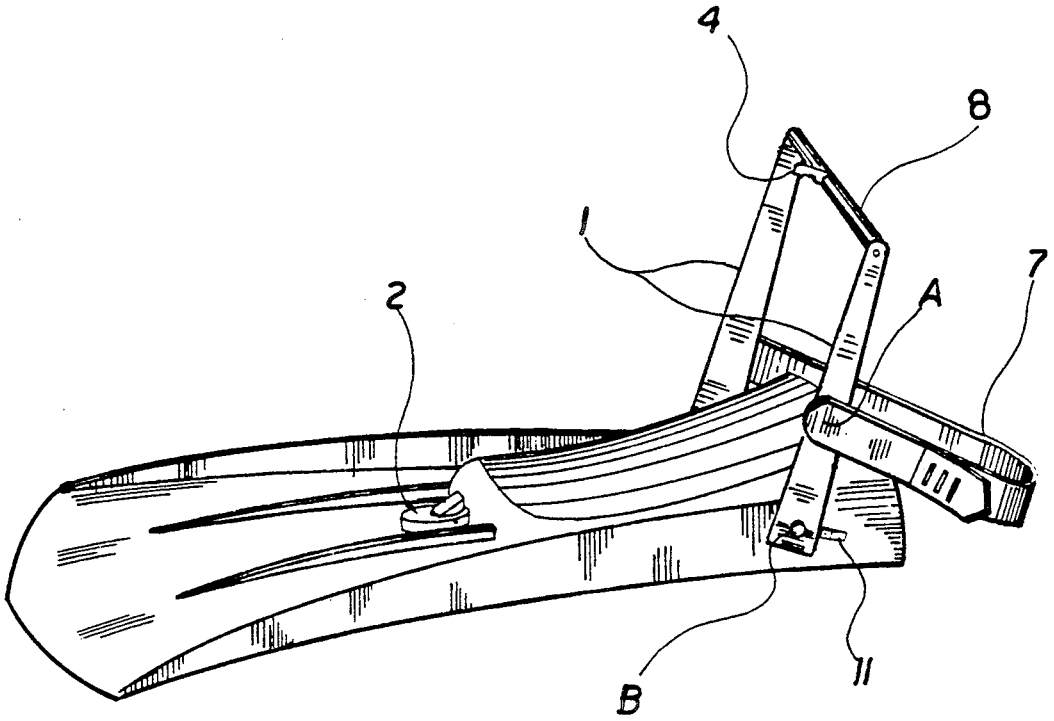
FIG. 3 shows a view of the entire fin with the locking mechanism in the open position.
Figure 5:
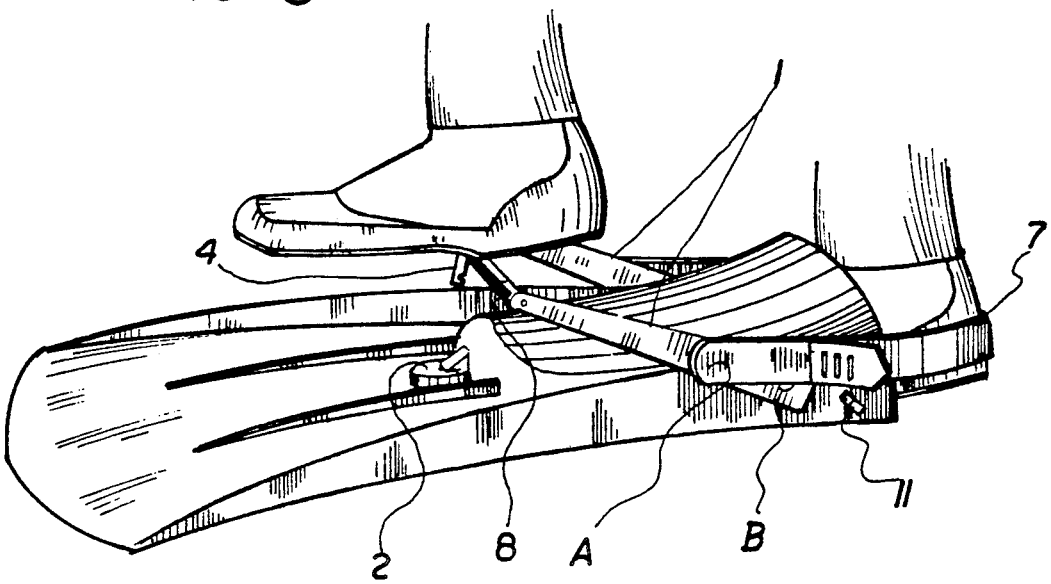
FIG. 5 shows the fin being put on and locked without using ones hands.

To put the swim fins on, the locking lever 1 is put in the released position C, see FIG. 3. Slip ones foot into the fin pocket see FIG. 5 and push locking lever 1 down until locked by the latch 2 see FIG. 5. To put the fins on without using one's hands, place the lever 1 in its fully released or open position against pivot stop 11 located on either side of the fin, see FIG. 3. Place or drop the fin on the ground. Then, slip ones foot over the heel strap 7 and into the foot pocket, as one would put on shoes. After placing ones foot into the foot pocket, using ones other foot press forward and down on cross bar 8 thereby moving lever 1 into its closed position until latched, see FIG. 5.

To remove the fin, release the latch by hand, and reverse the steps. The only way to release the latch is by hand. This is a precaution against accidently releasing the latch while in use if, for example, the foot bumped against a rock. The cross bar 8 serves as a protection from this possibility.

Tightening of the fin strap 7 is accomplished by attaching the fin strap 7 to lever 1 at point A. This can be done manually before the swim fins are used. See FIG. 1. With lever 1 pivotally attached to fin at point B, moving lever 1 from the released position C to the locked position D causes heel strap 7 to tighten behind the heel of the swimmer's foot. The fin strap extension 3 is attached to the back of the heel strap 7 and to the bottom of the swim fin pocket at point E. The extension 3 is used to automatically position the fin strap 7 onto the swimmer's foot.

The fin strap extension 3 is an option and when it is used it serves to hold up the heel strap and the bottom of the swimmer's heel. It can be molded to the heel strap 7. The heel strap 7 can be manually set before the swim fin is placed on the swimmer's foot. This is set to a length that corresponds to the size of the swimmer s heel or, in other words, the amount of the swimmers heel that will be sticking out of the back of the swim fin. This manual adjustment of the length of the heel strap uses any conventional, prior art system. This is the method by which the strap 7 is attached to the lever 1 at point A in FIG. 1.

Figure 4:
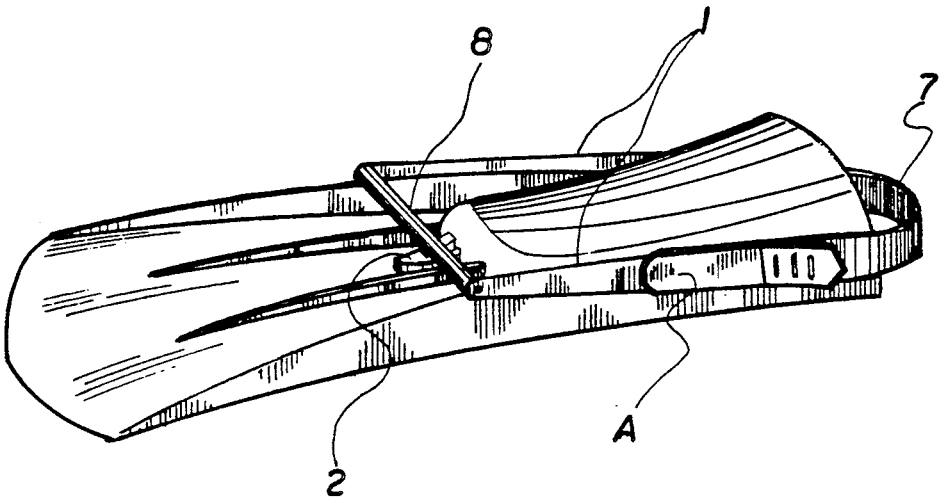
FIG. 4 shows a view of the entire fin with the locking mechanism in the closed or locked position.

During the locking and unlocking of the lever 1 the heel strap position will also change as it allows the heel strap to be secured or removed depending on whether the fin is being put on or off. The heel strap will be extended or retracted by changing the lever's (1) position from the open position in FIG. 3 to the closed position in FIG. 4. With the heel strap 7 attached to lever 1 at point A which is a radial position in relation to the pivot point (B). When the lever 1 is moved, the relation of the point A to the foot pocket F is either moved toward or away from the opening of the foot pocket. With the heel strap 7 attached at point A this causes the heel strap 7 to close around the foot pocket opening 12 in FIG. 3 or to open, move away in direct relationship of the pivoting of the lever 1 and radial point A.

I claim:

1. An improved swim fin retaining device comprising:

a hollow foot receiving portion having an opening capable of allowing a swimmer to insert a foot into said foot receiving portion, heel strap located around said opening and connected to said foot receiving portion, said heel strap capable of encircling the heel of the swimmer's foot and keeping said foot in said foot receiving portion when said strap is tightened, locking assembly having a locking member extending across the top of said foot receiving portion and pivotally connected to said swim fin, said locking assembly connected to said heel strap; said locking, assembly capable of releasably securing the swimmer's foot in said foot receiving portion and tightening said heel strap securely against the swimmer's heel when said locking assembly is pushed down; said locking assembly capable of releasing said heel strap when said locking assembly is pulled up.

2. The apparatus of claim 1 wherein said locking assembly comprises:

a) locking latch capable of up and down movement, b) a resilient means capable of maintaining upward pressure on said latch and allowing said latch to be depressed downward when said latch is moved down, c) locking pin on said locking member having a cut out portion behind the tip of said pin, said pin projecting downward toward said locking latch and capable of pushing said latch aside when said pin is pushed down, said pin capable of being locked into position by the pressure of said locking latch against said cut out portion after said cut out portion has been depressed below said latch, said locking pin capable of being released from locked position when said latch is pressed down, said pin being connected to said heel strap by a connecting means so that said heel strap is tightened in relation to said foot receiving portion when said pin is pushed down and being released away from said foot receiving portion when said pin is pulled up.

3. The apparatus of claim 2 where in said locking member a bar is connected to said locking pin, said bar capable of allowing said pin to be pushed down into locked position and capable of allowing said pin to be pulled up by after said pin is released.

4. The apparatus of claim 3 wherein said connecting means is a connecting strap that connects said heel strap to said locking pin, said heel strap capable of being adjusted in terms of distance said heel strap projects from said connecting strap.

5. The apparatus of claim 3 wherein a heel extension piece is attached to said foot receiving portion and to said heel strap; said extension piece positioned below said opening and capable of being extended at various lengths from said foot receiving portion.

* * * * *